United States Patent [19]

Melton

[11] Patent Number: 4,807,684

[45] Date of Patent: Feb. 28, 1989

[54] ROLL UP CLOSET DOOR

[76] Inventor: John G. Melton, 489 Panama Ave., Chico, Calif. 95926

[21] Appl. No.: 60,651

[22] Filed: Jun. 11, 1987

[51] Int. Cl.[4] ..... E06B 9/14

[52] U.S. Cl. ..... 160/23.1; 160/271; 160/310; 160/133

[58] Field of Search ..... 160/23 R, 26, 29, 31, 160/32, 33, 120, 121 R, 133, 268 R, 310, 311, 312, 270, 271, 272, 273 R, 274, 275, 276, 277, 278, 279, 280, 281, 282, 283, 284, 285, 286, 287, 288, 289

[56] References Cited

U.S. PATENT DOCUMENTS

| | | | |
|---|---|---|---|
| 1,749,199 | 3/1930 | Traut | 160/272 X |
| 2,870,831 | 1/1959 | Peselnick | 160/120 |
| 3,142,333 | 7/1964 | Kummerman et al. | 160/133 X |
| 3,430,677 | 3/1969 | Pierce | 160/264 |
| 3,672,492 | 6/1972 | Sherr | 160/133 X |
| 3,719,220 | 3/1973 | Small | 160/23 R X |
| 3,822,733 | 7/1974 | Lindelow | 160/120 |
| 4,197,896 | 4/1980 | Reichstadt | 160/133 X |
| 4,501,963 | 2/1985 | Perisic | 160/133 X |
| 4,692,847 | 9/1987 | Gandy | 160/378 X |
| 4,712,599 | 12/1987 | Komaki | 160/133 |

*Primary Examiner*—Ramon S. Britts
*Assistant Examiner*—David M. Purol

[57] ABSTRACT

The invention provides a roll up closet door in a tubular housing. Spring or electrical roll up and roll down assist mechanics are included and the door housing is extendable to fit a variety of household closet door widths.

2 Claims, 2 Drawing Sheets

ROLL UP CLOSET DOOR

BACKGROUND OF THE INVENTION

1. Field of the Invention

This invention relates to roll up doors. The present invention is particularly directed towards roll up doors specially designed for interior closets. The mechanics of the door would include both manual and power-assist applications.

2. Description of the Prior Art

The present invention appears unique in that most roll up doors are for weather-side installations while the present invention is designed specifically for interior use. Most interior-type devices disclosed were seen in classes and subclasses 160/264, 268S, 266, 272, 273, and 274. The following patents seem most pertinent to the present invention: A patent issued to Clark on Apr. 8, 1873, U.S. Pat. No. 137,595, discloses rolling metallic shutters which ride in a leather padded track, and a patent numbered 1,746,723, dated Feb. 11, 1930, granted to Valentine illustrates rolling window screens and the like. A roll up door similar to a roll front desk door is shown in the German patent numbered 2,172,956, issued Sept. 12, 1939. A covered top roller is shown in the Novales curtain assembly of Pat. No. 3,116,097, dated Dec. 31, 1963, and double curtains are seen in Pat. No. 3,237,682, dated Mar. 1, 1966, issued on Davis.

The Pierce device shown in Pat. No. 3,430,677, is a roll-type flexible sheet closure rolled on a drum and using a spring similar to a roll up house shade for powering the roller. The Pierce patent is dated Mar. 4, 1969, and in a similar structure, Clark, Pat. No. 3,292,685, issued Dec. 20, 1966, adds a vertically positioned motor for powering a horizontal shaft. A rolling screen assembly is illustrated in Pat. No. 3,882,921, dated May 13, 1975, issued to Sandall of England.

SUMMARY OF THE INVENTION

In practicing my invention, I have structured a roll up door designed exclusively for interior use, particularly for inside closet doors.

Therefore, a primary object of my invention is to provide a roll up door which allows full access to a closet or storage area.

Another object of the invention is to provide a roll up door for interior closets which can be custom built for odd-sized openings.

A further object of this invention is to provide a roll up closet door for interior closets which is inexpensive to manufacture and maintain.

A still further object of my invention is to provide a roll up closet door in a kit form which is easy to install for the do-yourself installer.

Another object of the invention is to supply a roll up closet door which can be operated manually or with electrical power assistance.

Other objects and the many advantages of the invention will become clear with a reading of the numbered parts as described in the specification and comparing them with similarly numbered parts shown on the included drawings.

DRAWING REFERENCE NUMERALS

Figure 1:
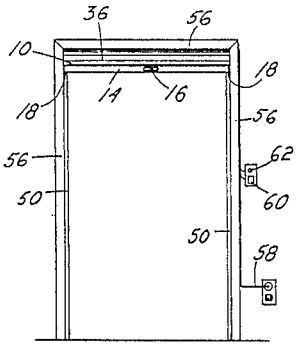
FIG. 1 shows the roll up closet door of the present invention installed in a closet door frame and in a rolled up position.

10 roll up door
12 interlocking door salts
14 door handle frame
16 indented door pull handle
18 spring loaded door track guides
20 compression springs
22 door axle shaft
24 electric motor
26 tension spring motor mounts
28 motor switching connectors
30 electic motor drive shaft
32 drive wheel
34 pressure-wind O-ring
36 door housing
38 motor housing
40 dual electric light housing (automatic open-door lighting)
42 light lenses
44 motor housing end plates
46 door axle shaft end plate hangers
48 mounting screws
50 roll up door retainer track
52 closet door lintel
54 closet doorjambs
56 closet door trim 58 electric motor input connection.
60 up-down motor switch
62 motor run LED
64 retainer track enlargement
66 retainer track enlarged cross section
68 track and door guide enlarged
70 optional extension breaks
72 directional attach indicator arrows
74 coil return spring
76 ratchet
78 short torsion spring
80 long torsion spring

DESCRIPTION OF THE PREFERRED EMBODIMENTS

Figure 2:
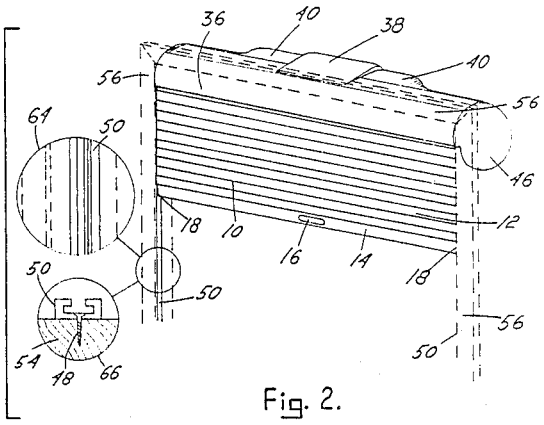
FIG. 2 is a perspective view of the roll up closet door of FIG. 1 with a circled enlargement of the jamb track in a vertical position and a circled enlargement of the jamb track in a side view sectioned.
Figure 6:
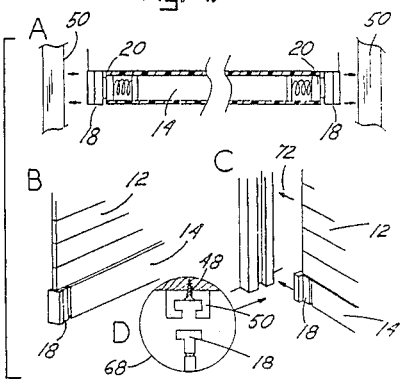
FIG. 6 at A shows a sectional view of the spring loaded door track guides, at B, the door guide is shown from an end view, at C, the door guide is illustrated positioned for insertion into the retainer track, and at D, shows the door guide aligned with the retainer track in a top sectional view.
Figure 7:
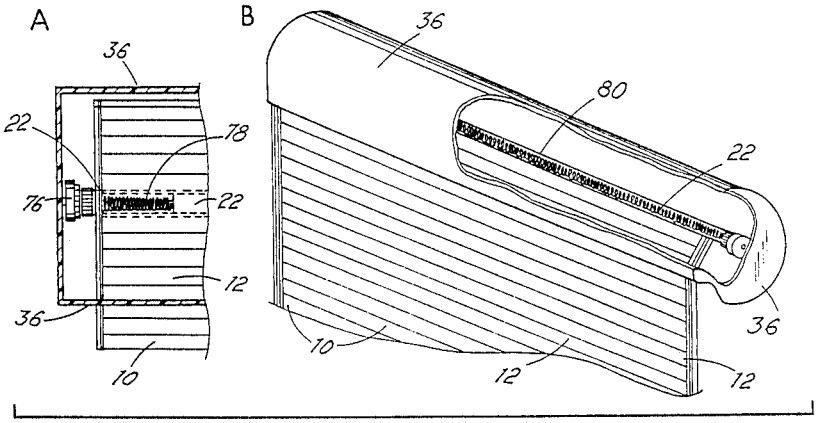
FIG. 7 at A shows a partial end cut-a-way view of the housing and spring-mechanics illustrating a short torsion spring affixed to a ratchet axle, and at B, the entire housing is shown with a partial cut-a-way view of one end to show use of a full length torsion spring for roll up assistance.
Figure 8:
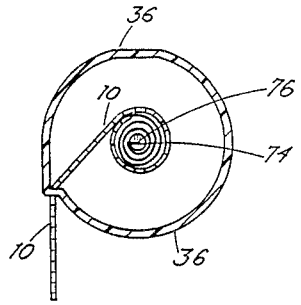
FIG. 8 is a sectional end view of the housing and the roll up door axle with a torsion return spring for manual roll-up assistance installed inside the door structure.
Figure 9:
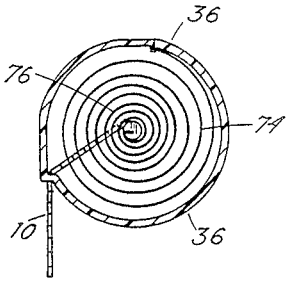
FIG. 9 is a sectional end view of the housing in an embodiment having a coil return spring in an encasement on the inside end of the door housing.
Figure 10:
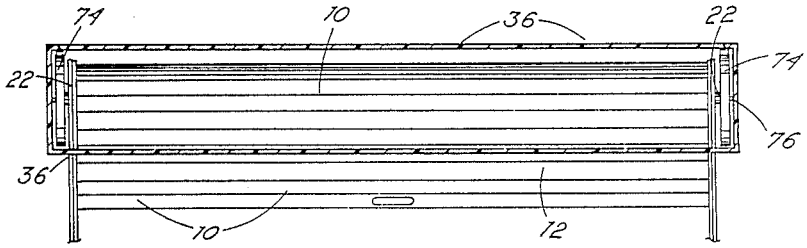
FIG. 10 shows the door housing in a front sectional view illustrating the coil spring of FIG. 9 housed at both ends of the door housing and affixed to both ends of the door axle shaft.

Referring now to the drawings and to FIG. 1 and FIG. 2. Roll up door 10 is structured of interlocking door slats 12 and affixed at the pull-down end with door handle frame 14. Indented door pull handle 16 is centrally positioned in door handle frame 14 and both ends are fitted with spring loaded door track guides 18 which retain and guide the sides of roll up door 10 in roll up door retainer track 50. The upper end of roll up door 10 is fastened to door axle shaft 22 and can be rolled up and down manually or electronically into and from door housing 36. For special alignment and track positioning, compression springs 20 keep door track guides 18 positioned properly in roll up door retainer track 50. For manually rolling up roll up door 10, a choice of three types of spring assist devices are supplable. FIGS. 7 through 10 illustrate the spring devices. In FIG. 7 at A, a short torsion spring 78 with ratchet 76 affixed to door axle shaft 22 which assists in roll up and allows stop and hold positioning of the door. In FIG. 7 at B, full length torsion spring 80 is illustrated in place of short torsion spring 78. The end caps on ratchet 76 are affixed stationary to door axle shaft end plate hangers 46 and do not turn with rotatable door axle shaft 22. One end of both the short torsion spring 78 and the long torsion spring 80 attaches through the hollow shaft of rotatable door axle shaft 22 inside to the stationary end cap of ratchet 76. The other end of both torsion springs 78 and 80 attaches to the core or the wall of rotatable door axle shaft 22 depending on the length of the torsion spring. This allows both torsion springs to unwind as interlocking door slats 12 are pulled downwardly and rewind as the roll up door 10 is pushed upwardly assisting in the upward rolling of interlocking door slats 12. The torsion spring embodiments are illustrated in FIG. 7. Coil return spring 74 is housed vertically in the end of door housing 36 with the center end affixed through a slot in door axle shaft 22 and the distal end affixed to the inside wall of door housing 36 as illustrated in FIG. 9. FIG. 8 and FIG. 9 show door housing 36 in an end sectional view and illustrate the use of coil return spring 74 as a manual return assist device for rolling up roll up door 10. FIG. 10 is a front sectional view of door housing 36 and shows how coil return springs are used on both ends of door axle shaft 22. Ratchet 76 is a pull and release ratchet which allows roll up door 10 to be operated much like a window shade. Ratchet 76 holds at any position that roll up door is stopped at. A further pull release roll up door for either roll up or roll down movement. Ratchets of this type are readily available in the market place and no inventiveness is claimed for rachet 76 except as used in the present invention. No assist springs or ratchets are used in the electrically motored embodiment illustrated in FIGS. 1 through 6.

Figure 5:
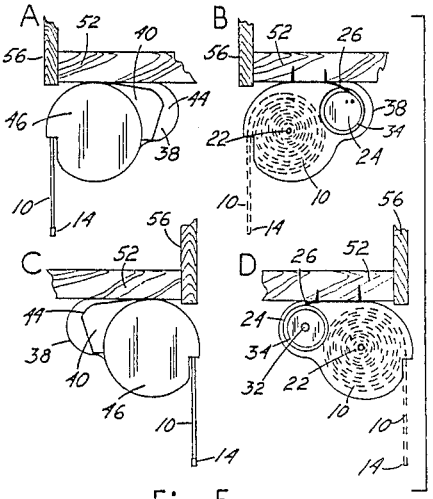
FIG. 5 at A is an end view of the door housing closed, at B the end view of the door housing is shown opened, at C, the opposite end of the housing is illustrated closed, and at D the opposite end of the housing is illustrated opened.

In FIG. 2, enlargment 64 shows roll up retainer track 50 in a vertical view and enlargement 66 shows the track in a sectional end view to illustrate how roll up door retainer track 50 is fastened to closet door jamb 54 by mounting screw 48. The illustration at FIG. 2 shows the complete door structure as fitted in the closet door with closet door trim 56 shown in dotted lines. Door housing 36 has door axle shaft and plate hangers 46 attached at each end. Duel electric light housing 40, which houses automatic lighting fixtures that turn on when roll up door 10 is opened in the rolled up position and shine into the closet area through light lenses 42, are shown adjacent motor housing 38. A mechanical relationship exists between electric motor 24 and the size of the roll of roll up door 10. When interlocking door slats 12 have increased the roll size on door axle shaft 22 to a preset amount, tension spring motor mounts 26 make an electrical contact with motor switching connectors 28 upwardly in motor housing 38 turning on lights in dual electric light housing 40 and shutting off power to electric motor 24. Up-down motor switch 60 overrides motor switching connectors 28 and causes electric motor 24 to operate in reverse from the direction of turn prior to stopping and current to light electric lights in electric light housing 40 is cut off turning off the lights. The pressure of pressure-wind O-ring 34 against interlocking door slats 12 is sufficient to wind and unwind roll up door 10 on door axle shaft 22 but not of sufficient pressure to cause the moving door to come down hard and injure a child or exert damaging force on an object placed under the door. Pressure-wind O-ring 34 would either spin free until a current increasing sensor switch, standard in the type of motor used, would shut down electric motor 24. The positioning of the lighting and motoring fixtures are best seen in illustrations, A, B, and C in FIG. 3. In FIG. 5 at A, door housing 36 is illustrated in an end view and is fastened to closet door sill 52 with closet door trim 56 at the front. The end of motor housing 38 is covered by motor housing end plates 44 and the door axle shaft and plate hangers 46 is illustrated. FIG. 5 at B is an opened drawing of A showing roll up door 10 rolled on door axle shaft 22 and illustrates the positioning of electric motor 24. Tension spring motor mounts 26 keep pressure wind O-ring 34 properly pressed against interlocking door slats 12 for electrical winding and unwinding of roll up door 10. To prevent injury or damage, drive wheel 32 is connected to electric motor 24 by circuitry which shuts off the power when a retarding pressure is exerted against roll up door 10 while moving in either an up or down direction. FIG. 5 at C and D is a reversed end illustration of the ends shown in A and B.

Figure 3:
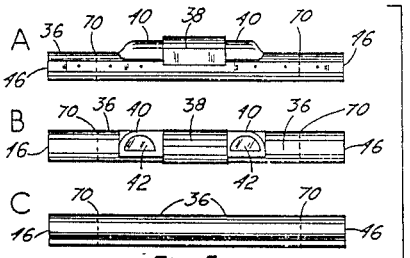
FIG. 3 shows the roll up door housing in a top plan view at A, in a view from inside a closet at B, and in a frontal view at C.
Figure 4:
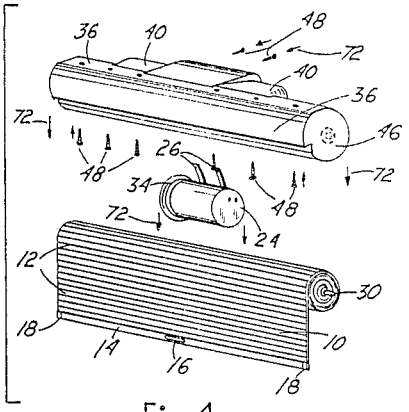
FIG. 4 illustrates the housing of FIG. 3 in a perspective view and shows the electrical-roll assist motor below the housing and below the motor is an illustration of the door structure partly rolled up on the shaft.

In FIG. 4, the basic parts of the present invention are shown with directional attach arrows 72 indicating attach positions. Although a variety of attaching methods may be used, mounting screws 48 are shown in the illustration. FIG. 6 enlarges and details door handle frame 14 and the spring loaded door track guide 18 arrangement. Compression springs 20 press door track guides 18 into retainer track 50. This allows for play in the door structure and for easy removal of roll up door 10 from retainer track 50 by pulling door track guides 18 back against compression springs 20. The enlargement detail 68 in FIG. 6 shows a top plan sectional view door track guides 18 in relationship to door retainer track 50. Door housing 36, as illustrated in FIG. 3 at A, B, and C can be opened and expanded at expansion breaks 70 to adjust roll up door housing 10 to fit closets of unusual size. Roll up door housing 10 is supplied in a variety of sizes to fit standard closet opening.

Although I have described embodiments of my invention with considerable details in the foregoing specification, it is to be understood that modifications in the design and structure may be practiced which remain within the intended scope of the appended claims.

What is claimed is:

1. A roll up closet door comprising:

a flexible door panel comprising a plurality of articulated slats having an upper end thereof secured to a rotatable axle shaft;

a roll up door housing comprising an elongated tubular member having a slot throughout its length thereof, said axle shaft being rotatably disposed within said housing, said door panel being adapted to pass through said slot into said housing upon rotation of said axle shaft;

a tension spring motor mount comprising a leaf spring plate having first and second ends, the first end of said leaf spring plate being secured within said housing, the second end of said leaf spring plate having secured thereto a reversible electric motor, said electric motor having an output shaft, a driver wheel secured to said output shaft, said driver wheel including a pliable O-ring tire affixed thereto, wherein, rotation of said output shaft effects rotation of said driver wheel;

said leaf spring plate continuously biassing said driver wheel into frictional contact with said flexible door panel such that rotation of said driver wheel effects rotation of said flexible door panel for accumulation thereof;

lighting means disposed within said housing;

a single manual override switch means for controlling the operation of said electric motor;

mechanical switch means disposed within said housing for engaging said leaf spring plate upon accumulation of said flexible door panel about said axle shaft, upon engagement of said mechanical switch means with said leaf spring plate, said mechanical switch means stops rotation of said axle shaft and actuates said lighting means;

upon disengagement of said mechanical switch means with said leaf spring plate, said mechanical switch means deactivates said lighting means;

door position retainer tracks comprising generally square tubular material having a longitudinal slot along the length thereof;

said flexible door panel having at its bottom end thereof spring loaded T-shaped door track guides for engagement with said retainer tracks.

2. The roll up closet door in claim 1 wherein said tubular housing is adjustable in length for fitting various sized closet door openings.

* * * * *